United States Patent [19]

Cardell

[11] Patent Number: 4,496,109

[45] Date of Patent: Jan. 29, 1985

[54] APPARATUS FOR CUTTING, ASPIRATING AND RETHREADING A TRAVELING FILAMENTARY YARN

[75] Inventor: Max L. Cardell, Shelby, N.C.

[73] Assignee: Celanese Corporation, New York, N.Y.

[21] Appl. No.: 499,005

[22] Filed: May 27, 1983

Related U.S. Application Data

[62] Division of Ser. No. 258,309, Apr. 28, 1981, abandoned.

[51] Int. Cl.[3] ..... B65H 54/02; B65H 67/04

[52] U.S. Cl. ..... 242/18 R; 242/18 PW; 242/35.5 A

[58] Field of Search ..... 242/18 R, 18 A, 18 DD, 242/18 PW, 35.5 A, 35.5 R

[56] References Cited

U.S. PATENT DOCUMENTS

| | | | |
|---|---|---|---|
| 3,791,126 | 2/1974 | Kose et al. | 242/35.5 A |
| 3,801,030 | 4/1974 | Kobatake et al. | 242/35.5 A X |
| 3,816,990 | 6/1974 | Hoffmann et al. | 242/35.5 A X |
| 3,820,730 | 6/1974 | Endo et al. | 242/35.5 A X |
| 3,908,918 | 9/1975 | Bergstrom | 242/18 R |
| 3,913,852 | 10/1975 | Lenk et al. | 242/18 A |
| 3,915,398 | 10/1975 | Corl | 242/35.5 A |
| 4,007,882 | 2/1977 | Isoard | 242/35.5 A |
| 4,023,741 | 5/1977 | Schar | 242/18 R |
| 4,052,017 | 10/1977 | Schar | 242/35.5 A |
| 4,069,983 | 1/1978 | Muramatsu et al. | 242/18 PW |
| 4,079,898 | 3/1978 | Murakami et al. | 242/35.5 A |
| 4,103,833 | 8/1978 | Hasegawa et al. | 242/18 A |
| 4,108,388 | 8/1978 | Schar | 242/18 R |
| 4,335,859 | 6/1982 | Courvoisier | 242/35.5 A |

*Primary Examiner*—Stanley N. Gilreath
*Attorney, Agent, or Firm*—Robert J. Blanke

[57] ABSTRACT

A filamentary yarn handling apparatus is arranged for use with a filamentary yarn winder of the type comprising a package support on which the packages are rotated. The yarn handling apparatus comprises a gathering head mounted above the package rotary axis for displacement toward the paths of travel of the yarns. The gathering head includes a cutter for severing each yarn and a suction tube whose inlet is disposed above the cutter for continuously drawing-in each yarn after severing has occurred. A yarn transfer mechanism includes two guides mounted for movement relative to the gathering head between upper and lower positions along one side of the package axis. With the transfer mechanism being in its upper position, the guides are respectively located between the rest position of said gathering head and the paths of yarn travel, respectively, such that when the cutter means severs the yarns and the gathering head returns to its rest position the yarns engage respective ones of the guides. The guides are moved from the upper position to the lower position relative to the gathering head and with the yarns remaining engaged with the guides, so that the yarns can be threaded onto empty packages. The gathering head is also usable on a hand-manipulable aspirator.

22 Claims, 26 Drawing Figures

22
F'
29'
46'
170
46
29
F, F'
108
41
212
210
182
56
58
50
60
14
174
184
172
200
202
202A
208
220
221
222
223
224
226
228
230
234
236
12

APPARATUS FOR CUTTING, ASPIRATING AND RETHREADING A TRAVELING FILAMENTARY YARN

This is a division of application Ser. No. 258,309, filed Apr. 28, 1981, now abandoned.

BACKGROUND AND OBJECTS OF THE INVENTION

The present invention relates generally to high speed winding of filamentary material onto bobbins or spools to form packages of filamentary material. More particularly, it relates to the handling of man-made filament yarn (continuously fed at say 100 mph) during removal of a full package (sidewound, crosswound yarn on a tube) and transfer of the continuously fed filament yarn onto an empty, rotating, flangeless tube, after which a further yarn package is formed.

The manufacture of man-made or synthetic filament yarns is typically achieved by extruding a molten polymer, such as polyester, polyamide, etc., through hole(s) in a spinneret and then cooling the filament(s) thus formed. Thereafter, the filaments may be gathered together to form a multi-filament yarn and, possibly after further treatment, are wound onto a tube so that a yarn package is formed.

Winding of the yarn is performed mechanically by winders which rotate one or more packages to wind-up the yarn while traversing the yarn along the package axis to achieve a uniform thickness of yarn being wound.

A doffing/donning operation (i.e., replacement of the yarn packages with empty tubes on the winder) is often performed manually by an operator who (i) severs the yarn, (ii) stops the rotary drive to the packages; (iii) replaces the packages with empty tubes; (iv) re-establishes the rotary drive; and (v) rethreads the yarn onto the empty tubes. Severing of the filamentary yarn is typically performed with scissors while the inlet of a suction or aspirator gun is held against the yarn at a location above the point of severing. Once the yarn is severed, the tail end is wound onto the yarn package, while the newly formed leading end is sucked into the aspirator and fed to a waste collector. The suction gun is then placed onto a holder while the yarn packages are being replaced by empty tubes. When the empty tubes attain full speed, the operator manipulates the suction gun to attach the yarn to the rotating tubes so that this winding operation may begin.

In order to economize such winding operations, it has heretofore been proposed to mechanize the doffing and donning operations to a certain extent by providing a mechanism which automatically severs, aspirates and rethreads the yarn. Exemplary of proposed mechanisms of that type are the disclosures in U.S. Pat. No. 4,023,741 issued to Schar on May 17, 1977; U.S. Pat. No. 4,052,017 issued to Schar on Oct. 4, 1977; and U.S. Pat. No. 4,108,388 issued to Schar on Aug. 22, 1978.

In the afore-mentioned U.S. Pat. No. 4,023,741, a mechanism is disclosed in which a cutter and aspirator are carried at the end of a reciprocable carrier arm. The carrier arm is extendable toward a pair of traveling yarns in a direction parallel to the yarn package axis such that the cutter sequentially severs the yarns and the aspirator exhausts same to waste while the packages are being removed. A pair of holders are arranged to capture the cut filaments being sent to waste. The carrier arm and the holders are rotatable downwardly together to a location on the opposite side of the winders (i.e., the cutter, aspirator, and holders travel through a vertical plane containing the bobbin axis) to thread the yarn onto the empty tubes. It will be appreciated that by requiring that the cutter and aspirator travel downwardly with the yarn holders, a more complicated mechanism results. Also, by moving the yarn holders through the vertical plane containing the yarn package axis, it is necessary to provide extra guides above the winder to engage and properly orient the yarns during the rethreading procedure. Crossing of the vertical plane also complicates the return of the holders to the upper position because care must be taken to avoid contact of the holders with the rethreaded yarns as the holders pass through the plane of the yarns. Also, the particular path assumed by the yarn holders appears to foreclose any chance that the yarns can be threaded into tailing guides which are commonly employed on yarn winders between the level of the yarn package axis and the level of the yarn traverse guide.

A particular type of cutter mechanism is disclosed in the afore-mentioned U.S. Pat. No. 4,108,388. That cutter mechanism includes a pair of superimposed cutter blades which are relatively movable. The blades include alignable slots which open to the side to admit a yarn directed toward the slot by cam surfaces at the front of the blades. After a yarn enters the slot, it becomes pinched between the relatively moving blades and is severed. It will be appreciated that the side-wise entry direction of the slot demands that a relatively precise alignment occur between the cutter and the yarns to assure that the yarns contact the front cam surface. Also, unless the relative movement between the cutter blades is very rapid, an inadequate cutting action may result because the filaments begin to slacken immediately upon being pinched between the relatively moving blades.

Although it has been heretofore proposed to provide a yarn cutter with scissors-type blades, thereby defining a forwardly open slot, there may not be means for capturing the filaments within the slot. Such a deficiency would not be desirable in cases where the yarn is being traversed and thus may be traveling in a direction away from the cutter at the instances when the blades close, i.e., the filaments may exit the cutter without being cut.

Even in the absence of automatic severing and aspirating, i.e., where a manually operable aspirator "gun" is employed, difficulties can be encountered in "capturing" a yarn for severing, especially when the yarn is located an arm's length or more away from the operator. For example, as is the case in one previously proposed aspirator gun a slot opens in a direction perpendicular to the suction tube. Thus, it is necessary for the operator to guess when the slot and yarns are aligned in order to capture the yarns. This can be a slightly difficult procedure, involving undesirable delays (e.g., see U.S. Pat. No. 3,175,290 issued to Bunting, Jr., et al on Mar. 30, 1965).

BRIEF SUMMARY OF THE INVENTION

The present invention involves a filamentary yarn handling apparatus for use with a yarn winder of the type comprising a yarn package support, and a drive unit for rotating at least one package about an axis of the support to wind-up at least one filamentary yarn continuously fed toward the winder. The yarn handling apparatus comprises a gather head placed upstream of the rotary axis of the package and capable of displacement from a rest position to intercept the path of travel of the yarn. The gathering head includes a cutter mechanism for severing the filament(s) in the yarn as the gathering head is displaced toward the yarn path of travel. A suction device of the gathering head includes an inlet disposed adjacent the cutter mechanism for continuously drawing-in each yarn and after severing of the yarn has occurred. A yarn transfer mechanism includes at least one guide associated with the yarn to be transferred and mounted for movement relative to the gathering head between spaced positions. The guide is arranged to engage the yarn when the gathering head is returned to its rest position with the severed yarn. A displacement mechanism is provided for moving the transfer mechanism relative to the gathering head, with the yarn remaining engaged with the guide, and for moving the guide toward the yarn package axis during the yarn rethreading sequence.

Other advantageous features of the invention will become apparent from the ensuing disclosure of a preferred embodiment thereof. For example, the gathering head is suited for mounting on a hand-held yarn cutter-/aspirator which is manually manipulated by the operator.

THE DRAWINGS

The advantages of the invention will become apparent from the following detailed description of a preferred embodiment thereof, in connection with the accompanying drawings in which like numerals designate like elements, and in which:

FIG. 18 is a cross-sectional view taken along line 18—18 of FIG. 17 depicting the mounting of a cam bar on a fluid inlet tube of the aspirator;

DETAILED DESCRIPTION OF A PREFERRED EMBODIMENT OF THE INVENTION

Automated Filament Handling Mechanism

Figure 1:
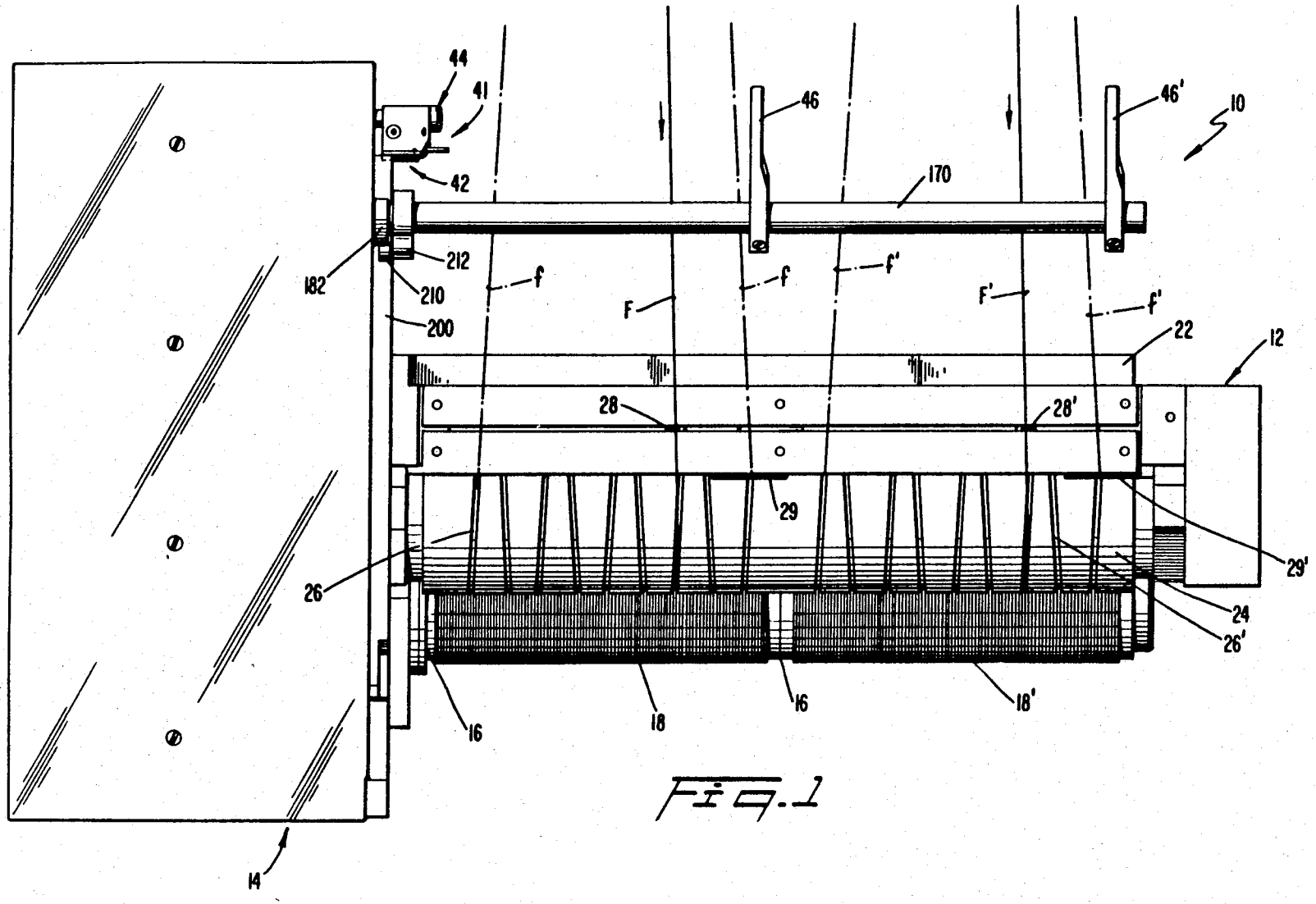
FIG. 1 is a side elevational view of the yarn handling apparatus of the present invention mounted on a conventional yarn winder.

A yarn cutter/aspirator 10 according to the present invention is depicted in FIG. 1 in conjunction with a yarn winder, such as a conventional yarn winder 12 of the type marketed as model No. SW 46 SSD by Barmag Barmer Maschinenfabrik A.G. The winder comprises a stationary frame 14 from which projects a yarn package axle or spindle 16 which supports a pair of conventional removable tubular packages 18, 18'.

Disposed above the spindle 16 is a package drive head 22 which is vertically reciprocably carried by the frame 14. Conventional power mechanisms (not shown) within the frame 14 raise and lower the drive head 22 upon suitable actuation thereof. The drive head 22 includes a helically grooved roll 24 mounted for rotation about an axis parallel to the package axle. During a winding operation, yarns F, F' pass downwardly through overhead guides or godets (not shown) and travel within the helical grooves 26, 26' of the roll 24 and also within horizontally reciprocable guides 28, 28' disposed above the respective grooves. The roll 24 is rotatably driven and the traversing guides 28, 28' are reciprocated along the packages axis to achieve a uniform distribution of the wound filaments along the yarn packages.

During such traversing movement, the yarns travel in a common vertical plane, each yarn bundle forming a fan-like pattern, the boundaries of which being indicated in broken lines ff, f'f' in FIG. 1. The yarn packages are driven by a drive roll (not shown) mounted on the drive head 22 behind the grooved roll 24. The drive roll rotates the yarn package through frictional contact therewith. As a yarn package fills with wound yarn, the drive head 12 is pushed upwardly by the peripherally accumulating yarn layers while continuing to make peripheral drive contact therewith.

Mounted on the winder above the grooved roll 24 are a pair of conventional tailing guides 29, 29' (FIG. 1) which contain slots for receiving the yarns. At the initiation of a winding operation, the tailing guides cause the yarns F, F' to be wound in a manner producing transfer tails on the tubes which facilitate eventual unwinding of the yarn by the user of the yarn. These tailing guides 29, 29' are well-known and a further description thereof is unnecessary.

Disposed at a lower side of the winder is a conventional rod 30 (see FIG. 8) which carries a pair of pig-tail shaped throw-on guides 32, 32'. The rod includes a mounting section 30A which is mounted on the drive head 22 for rotation about an axis extending parallel to the package axis. The rod 30 is normally stored behind the winder chuck but can be swung forwardly so that a mounting section of the rod extends parallel to the package axis. The rod 30 carries a pair of throw-on guides 32 (only one throw-on guide 32 being depicted) which are aligned vertically with respective ones of guide arms 46, 46' to be discussed. During a rethreading operation, the throw-on guides 32 receive the yarns (see the solid line illustration in FIG. 8) and are then swung rearwardly (see the broken line position of FIG. 8) to carry the yarns against the package tube and into pinched slots formed in the packages, whereupon a new winding operation commences. Further details of this throw-on mechanism from U.S. Pat. No. 4,146,186 assigned to Barmag Barmer Maschinenfabrik A.G., Federal Republic of Germany, the disclosure of which patent is hereby incorporated as if set forth at length herein.

In order to replace or doff the packages when the winding operation is finished, it is necessary to sever all the filament(s) in the yarn. Since the source of filamentary yarn supply cannot be shut off during the doffing sequence, the yarns continue to be supplied and must be carried to storage or waste. After the filled packages are removed from the winder chuck and empty packages are installed thereon, the yarns must be threaded into the tailing guides 29, 29' and attached to the empty package tubes.

In accordance with the present invention, there is mounted to the frame 14 a yarn handling mechanism which automatically cuts the yarns, aspirates the yarns to waste, and rethreads the yarns onto empty packages. Basically, the yarn handling mechanism comprises a movable gathering head 41 which includes a cutter mechanism 42 and an aspirator mechanism 44, and a pair of guide arms 46, 46' which are movable relative to the gathering head 41 to transfer the yarn to the empty packages.

Figures 14, 15, 16:
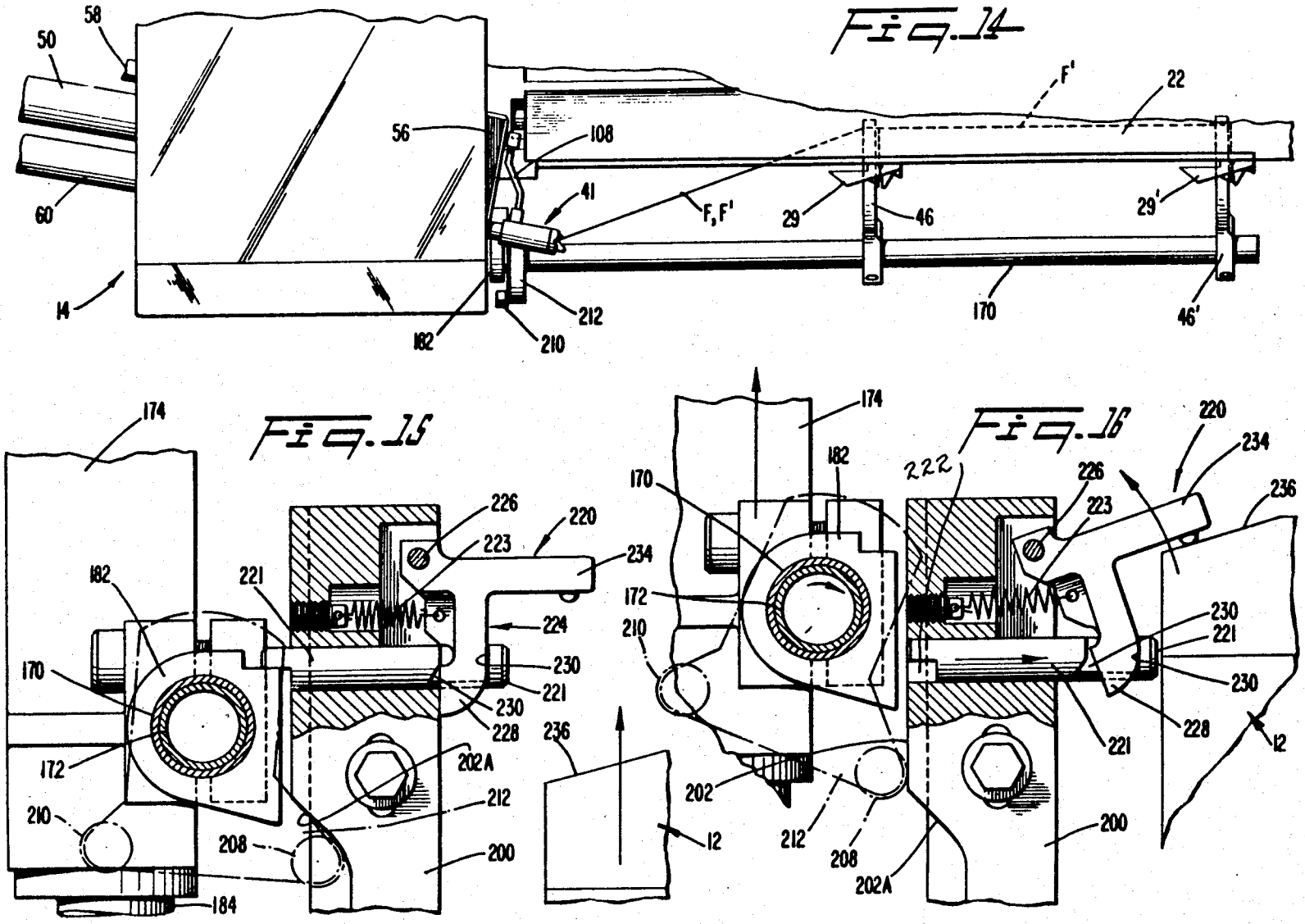
FIG. 14 is a plan view similar to FIG. 13 depicting the operational step corresponding to that depicted in FIG. 8.
FIG. 15 is a side elevational view, partially broken-away of a latching mechanism of the yarn handling apparatus.
FIG. 16 is a view similar to FIG. 15 depicting the latch in a retracted mode.
Figures 14, 17:
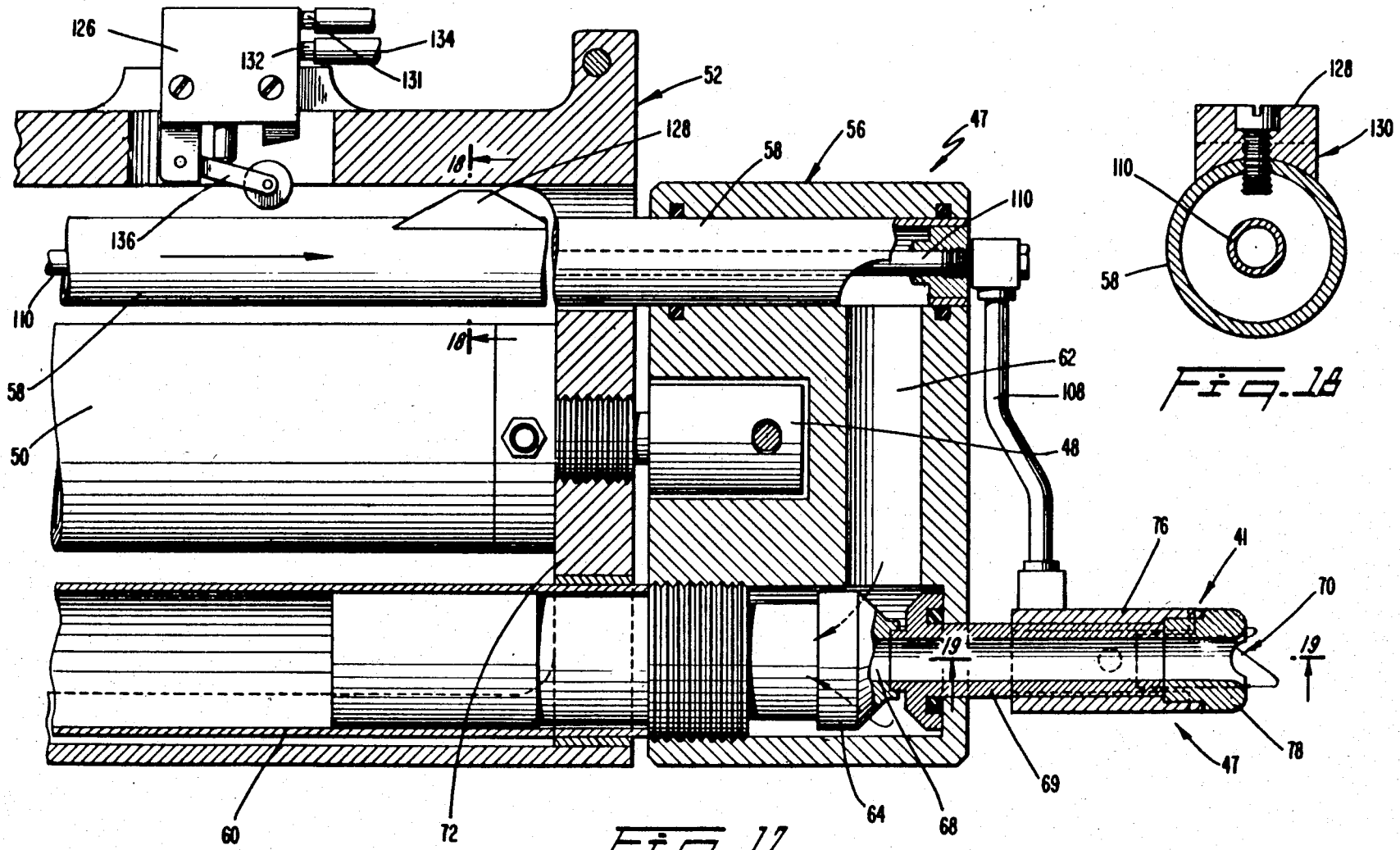
FIG. 17 is a longitudinal sectional view through a cutting/aspirating portion of the yarn handling apparatus according to the present invention in a retracted mode.

The gathering head 41 forms part of a reciprocable unit 47 carried at the front end of an extendible/retractible rod portion 48 of a fluid actuated cylinder 50 (FIG. 17). The cylinder 50 is mounted on a housing 52 which is swingable relative to the frame 14 about a vertical pivot post 54 (compare FIGS. 10 and 12).

The reciprocable unit 47 further includes a casing 56 (FIG. 17) to which are mounted the front ends of a pair of elongate conduit tubes 58, 60 that travel along with the casing. One of the tubes is connected at its rear end to a source of pressurized fluid, preferably air, and conducts that air through a cross bore 62 in the casing to the other tube 60. The latter tube 60 comprises a conventional aspirator which includes a suction-inducing nozzle ring 64 through which the air is conducted. Flow of air rearwardly into a central passage 68 of the aspirator tube creates a suction at the inlet 70, which inlet is formed in a suction conduit extension 69 of the air exhaust tube 60 and is situated at the gathering head 41. As noted earlier, the thus-described aspirator is of a conventional nature, one suitable type being marketed by the Slack & Parr Corp.

The air inlet and exhaust tubes 58, 60 and the fluid cylinder rod 48 are slidably disposed within openings in a front wall 72 of the housing. The tubes 58, 60 are also slidably disposed within apertures in a rear wall 74 of the housing.

Figure 2:
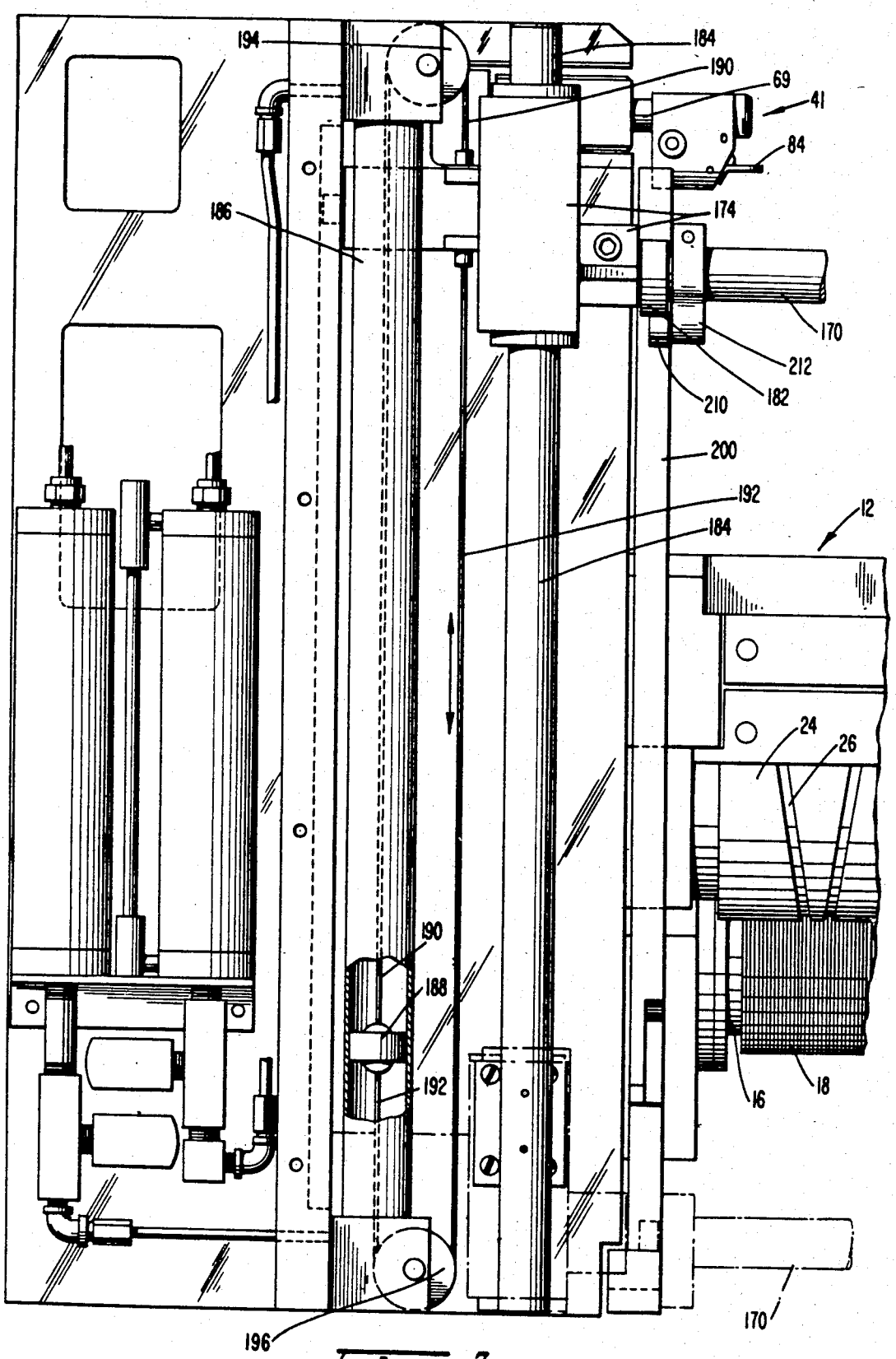
FIG. 2 is a side elevational view of a drive mechanism for the yarn transfer portion of the apparatus, with a side portion of the frame removed to expose the components.

A preferred gathering head 41 includes a sleeve 76 mounted on the forward end of the suction conduit 69 (FIGS. 17, 19), which sleeve houses the cutter mechanism 42 as well as a tip 78 for the inlet of the suction conduit. This tip is formed of low-friction material and includes a vertical slit 80 across the inlet 70, which slit receives filaments and locates same relative to the suction inlet 70. The sleeve is held to the suction conduit 69 by means of a fastener 79 having a wedge face 79A which wedges against the conduit 69 when the fastener is installed (FIG. 2).

The cutter mechanism 42 is situated in a lower portion of the sleeve 76 and includes a pair of relatively movable cutter blades 82, 84 disposed within a chamber 86 of the sleeve. One of the cutter blades 84, hereafter designated as a stationary blade, is freely mounted to the sleeve by a horizontal pin 85. This stationary cutter blade 84 includes a forwardly projecting portion 88 which forms a yarn-catching slot 90. This slot comprises a pair of forwardly diverging side walls 92, 94 communicating at their rear ends with a lateral portion of the slot in the form of a vertical through-passage 96. The through-passage 96 includes a curvilinear front wall 98 which, at an upper surface of the plate, is relatively sharp to form a cutting edge, as will be discussed hereinafter. The lower portion of the through-passage is flared outwardly at 100.

The other cutter blade 82, hereafter designated as the reciprocable blade, is mounted for reciprocable movement within the chamber 86 and carries an annular seal 102 to create a fluid-tight work compartment 104 (FIG. 22) within the chamber 86, which compartment 104 communicates with pressurized fluid, preferably air, via an inlet 106 in the sleeve 76. This inlet 106 communicates with a flexible hose 108 (FIGS. 17, 22) which is attached to a pipe 110 extending coaxially within the air inlet tube 58 (FIG. 17). By alternately supplying air to, and exhausting air from, the work compartment 104, the reciprocable blade member 82 is displaced forwardly and rearwardly. Rearward displacement is effected by means of a spring 112, preferably a coil compression spring, which acts between the reciprocable cutter member 82 and a rear end of the yarn-capturing blade member 84. The spring 112 acts against the stationary blade 84 below the pin 85 so that a moment is imparted to the stationary blade 84 which tends to press the latter against the reciprocable blade 82. During a cutting stroke, the plane of the stationary blade extends upwardly at an angle a of from one to three degrees (preferably two degrees) relative to the plane of the stationary blade to assure a line-to-surface contact therebetween and facilitate self-sharpening of the blades.

Figures 19, 20, 21, 22:
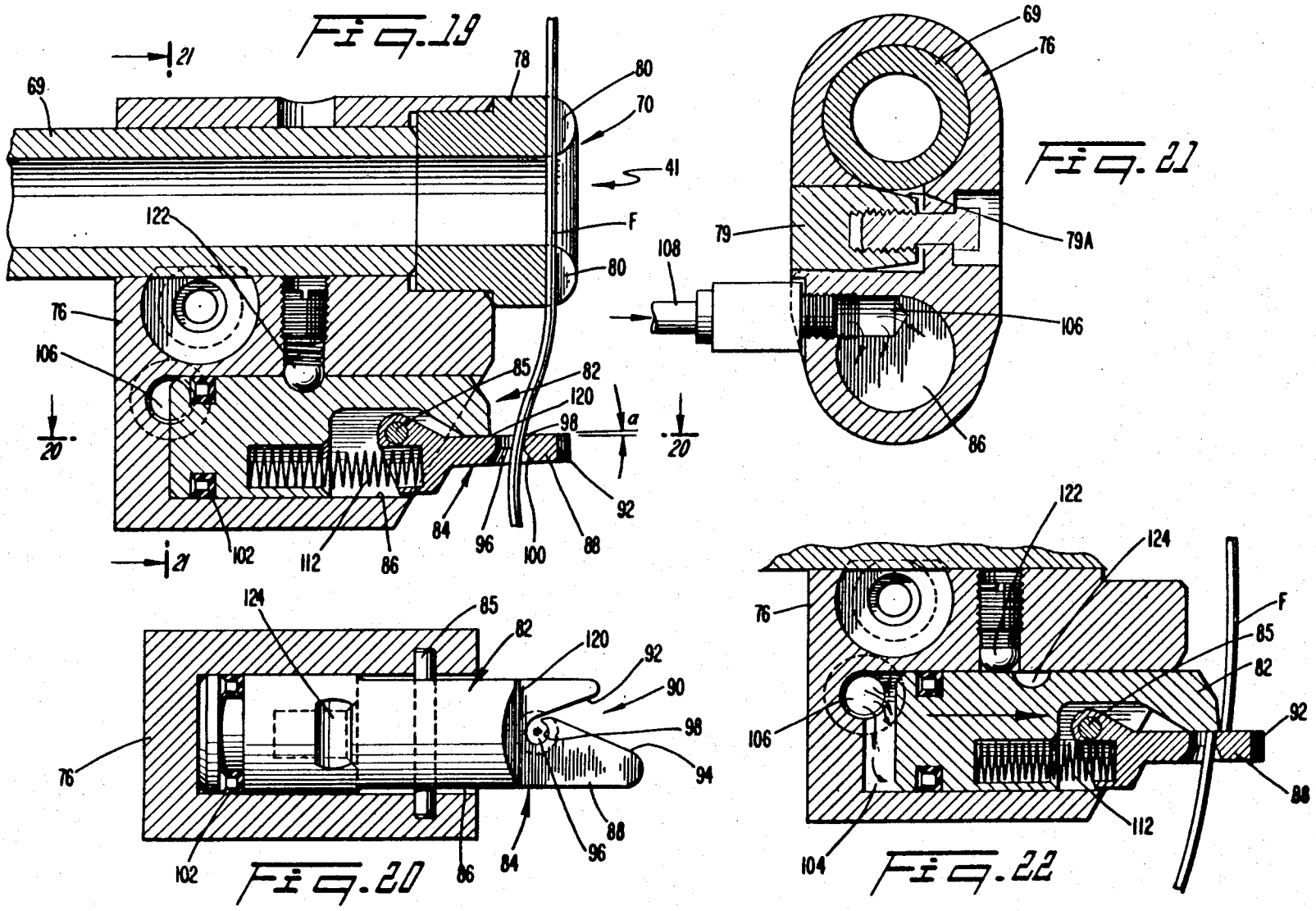
FIG. 19 is a longitudinal sectional view taken along line 19—19 of FIG. 17 depicting a gathering head portion of the yarn handling apparatus.
FIG. 20 is a sectional view taken along line 20—20 of FIG. 19 depicting a stationary cutter blade in plan.
FIG. 21 is a sectional view taken along line 21—21 of FIG. 19.
FIG. 22 is a fragmentary view corresponding to FIG. 19 depicting the relationship of the cutter mechanism immediately following the severing of the yarns.

The front end of the reciprocable blade 82 includes a sharp edge 120 disposed in contact with the upper surface of the stationary blade 84. Preferably this edge 120 extends perpendicularly to the direction of reciprocation of the blade 82. During a forward stroke of the reciprocable blade the edge 120 passes completely across the through-passage 96 in the stationary blade 84. Accordingly, a yarn F which is captured within the through-passage is severed by a highly efficient combination scissors/shear action between the straight edge 120 and the curved upper edge of the front wall 98 of the through-passage (FIG. 22). The diameter of the yarn F is exaggerated in FIGS. 19, 22 for clarity.

The interaction occurring between these two edges is enhanced by the action of the spring 112 since the stationary blade is urged upwardly against the reciprocable blade as noted earlier.

In order to assure that a quick, clean severing of the yarn occurs, the reciprocable cutter member is constrained for rapid "snap-like" movement. This is achieved by a spring-biased ball detent 122 which engages a recess 124 in the top surface of the reciprocable blade 82 when the latter is in a retracted or rearward position (FIG. 19). The detent 122 prevents reciprocable movement of the latter until a selected pressure build-up occurs in the working compartment 104. Thus, instead of a more gradual advance of the reciprocable blade 82 which might result in an uneven, jagged cutting of the moving yarn and resultant unbraiding thereof, a rapid, clean severing occurs.

The through-passage 96 of the stationary blade 84 is disposed rearwardly of the yarn-receiving slit 80 of the aspirator tip 78 to assure that at the instant severing occurs, the yarn F is pressed firmly into the slit 80 and thus suitably positioned for capture by the induced suction at the aspirator inlet 70.

Reciprocation of the reciprocable blade 82 is produced, as noted earlier, by alternately supplying pressurized fluid to, and exhausting it from, the work compartment 104. This is achieved by means of a cam-operated poppet valve 126 (FIG. 17) which is actuated by two sets of cams 128, 128' carried by cam bars 130, 130' mounted on the aspirator air inlet tube 58. The poppet valve 126 is of a conventional nature and has a fluid inlet 131 which is connected to the pressurized fluid source, and a fluid outlet 132 to which the rear end of the fluid supply pipe 110 is connected via a flexible hose 134 (see FIGS. 17, 10). A spring-biased cam follower arm 136 of the valve is arranged to be sequentially contacted and displaced by the cams 128 on the aspirator fluid supply tube 58. When displaced, the cam follower arm 136 opens the poppet valve 126 and directs fluid to the working compartment 104 of the sleeve 76 to urge the reciprocable blade 82 forwardly. The poppet valve is mounted on the housing 52 and thus remains stationary while the reciprocable unit 47 is being displaced forwardly and rearwardly.

Mounted on the housing 52 are a pair of limit switches 140, 142 (FIG. 10) which are contacted and activated by portions of the reciprocable unit 47 to create signals when the reciprocable unit is in extended and retracted positions. That is, the first limit switch 140 is activated when the casing is in a fully extended condition, and the second limit switch 142 is activated when the casing is in a fully retracted condition.

As noted earlier, the housing 52 is rotatable about a vertical pivot pin 54. That pivotal movement is imparted by a fluid-actuated ram 146 (FIG. 10) which is pivotably mounted between the frame 14 and the housing 52. The ram 146 is actuated in response to activation of the second limit switch 142 when the reciprocable unit 147 returns to its retracted position. Third and fourth limit switches 150, 152 are mounted on the frame 14 and are activated when the housing 52 is in a rotated position (FIG. 12) and a non-rotated position (FIG. 10), respectively. The purpose of these limit switches is to provide signals for actuating the machine logic, as will be explained subsequently.

Figure 10:
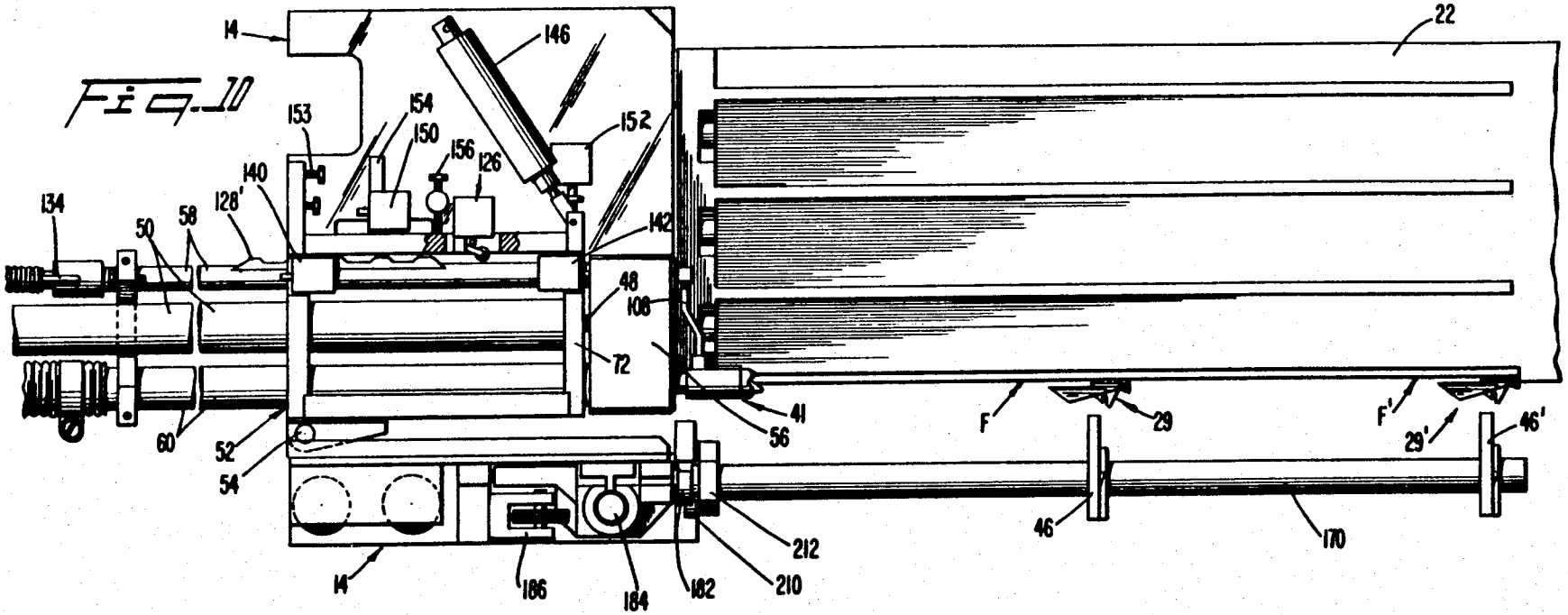
FIG. 10 is a plan view of the winder and yarn handling apparatus according to the present invention, and the operational step depicted in FIGS. 1, 2, and 3.
Figure 11:
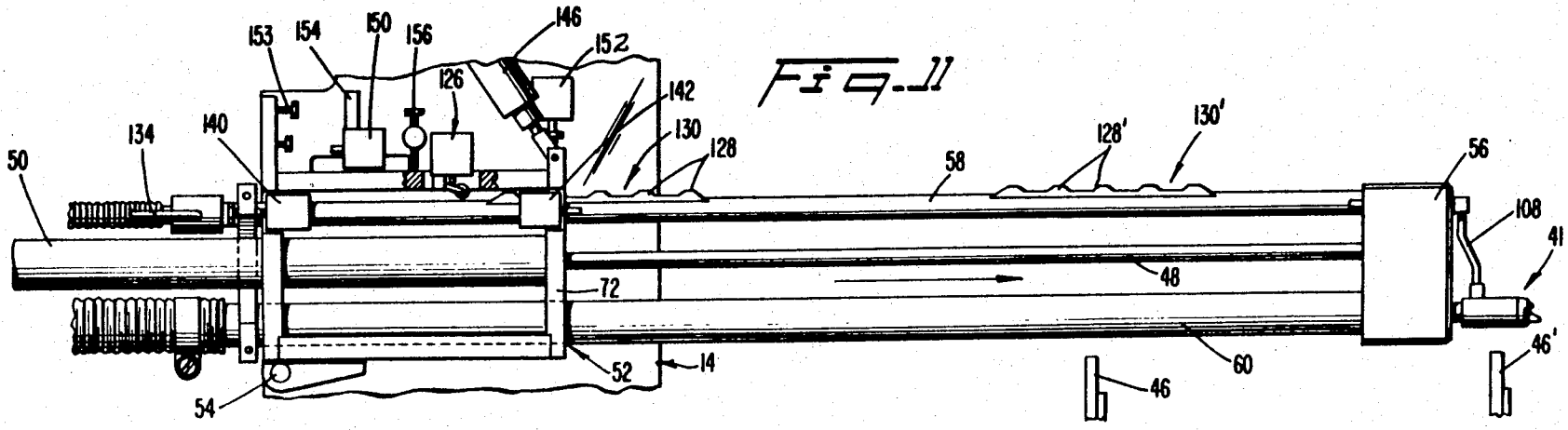
FIG. 11 is a plan view of the yarn handling apparatus and depicts a step in the operational step corresponding to that depicted in FIG. 4.
Figure 12:
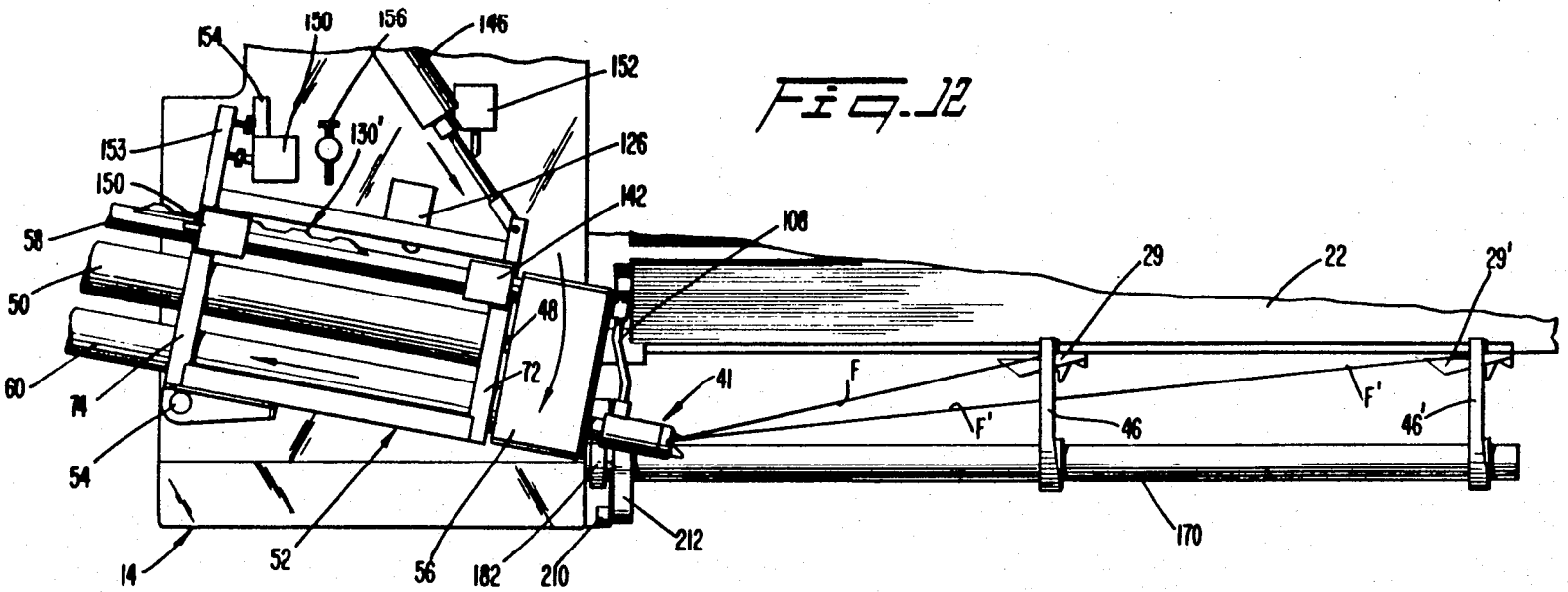
FIG. 12 is a plan view similar to FIG. 11 depicting the operational step corresponding to that depicted in FIG. 6.

A first adjustable limit screw 153 is mounted on the housing 52 and is engageable with a portion 154 of the frame 14 to define a stop for the housing in a rotated condition (FIG. 12). A second adjustable limit screw 156 is mounted on the frame 14 and is engageable with the housing 52 to define a stop for the latter in its non-rotated condition (FIG. 10). Rotation of the housing 52 is the last movement in the operation of the gathering head portion of the yarn handling mechanism.

The operation of the gathering head 41 commences at the termination of a winding step, i.e., when it is time to doff the filled packages 18, 18'. At such time a signal is sent, either by an operator pushing a "stop" button on the winder 10 or perhaps by a computer in an automated plant, which causes the fluid cylinder 50 of the yarn handling mechanism to extend the gathering head forwardly. The front end of the yarn-capturing slot 90 in the stationary blade 84 is generally coplanar with both yarns F, F' with the dimension of the slot mouth or inlet being large enough to accommodate displacements of the yarns from such common vertical plane. Thus, it is assured that eventually, as the gathering head advances, the initial yarn F will enter the slot 90 and become captured in the through-passage 96. At the same time, the yarn F becomes confined within the vertical slit 80 in the aspirator tip 78 and is thus aligned with the suction inlet 70.

When the cams 128 on the air inlet tube 58 begin making contact with the actuating arm of the poppet valve 126, pressurized fluid is repeatedly supplied to the working compartment 104 in the gathering head 41 to build-up pressure therein and overcome the bias of the ball detent 122. When that occurs, the reciprocable blade 82 snaps-out and its cutter edge 120 passes across the through-passage 96 and severs the yarn F. The spring 112 urges the stationary blade 84 firmly against the reciprocable cutter edge 120 to produce a clean cut through the yarn. It will be appreciated that the cutter operates in response to each cam signal regardless of whether severing has or has not occurred. A sufficient number of cams 128 are provided to provide sufficient opportunity for the yarn to be captured in the slot 90, 96.

When severed, the yarn F is immediately caught-up in the continuously induced suction at the aspirator inlet 70 and is conducted to waste via the air outlet tube 60.

The gathering head 41 continues forwardly and performs a similar severing of the second yarn F'. Thus, both yarns F, F' are being exhausted to waste, enabling the package 18, 18' to be replaced, either manually or perhaps by an automated robot.

At the forward end of the stroke of the gathering head 41, the limit switch 140 is activated and signals the drive head 22 to ascend, thereby breaking the drive connection to the yarn packages which are automatically braked.

Prior to retraction of the gathering head 41, the aforementioned guide arms 46, 46' of the transfer mechanism are displaced toward the vertical yarn plane and the arrangement of such guide arms 46, 46' shall now be discussed in more detail.

Figures 23, 24, 25, 26:
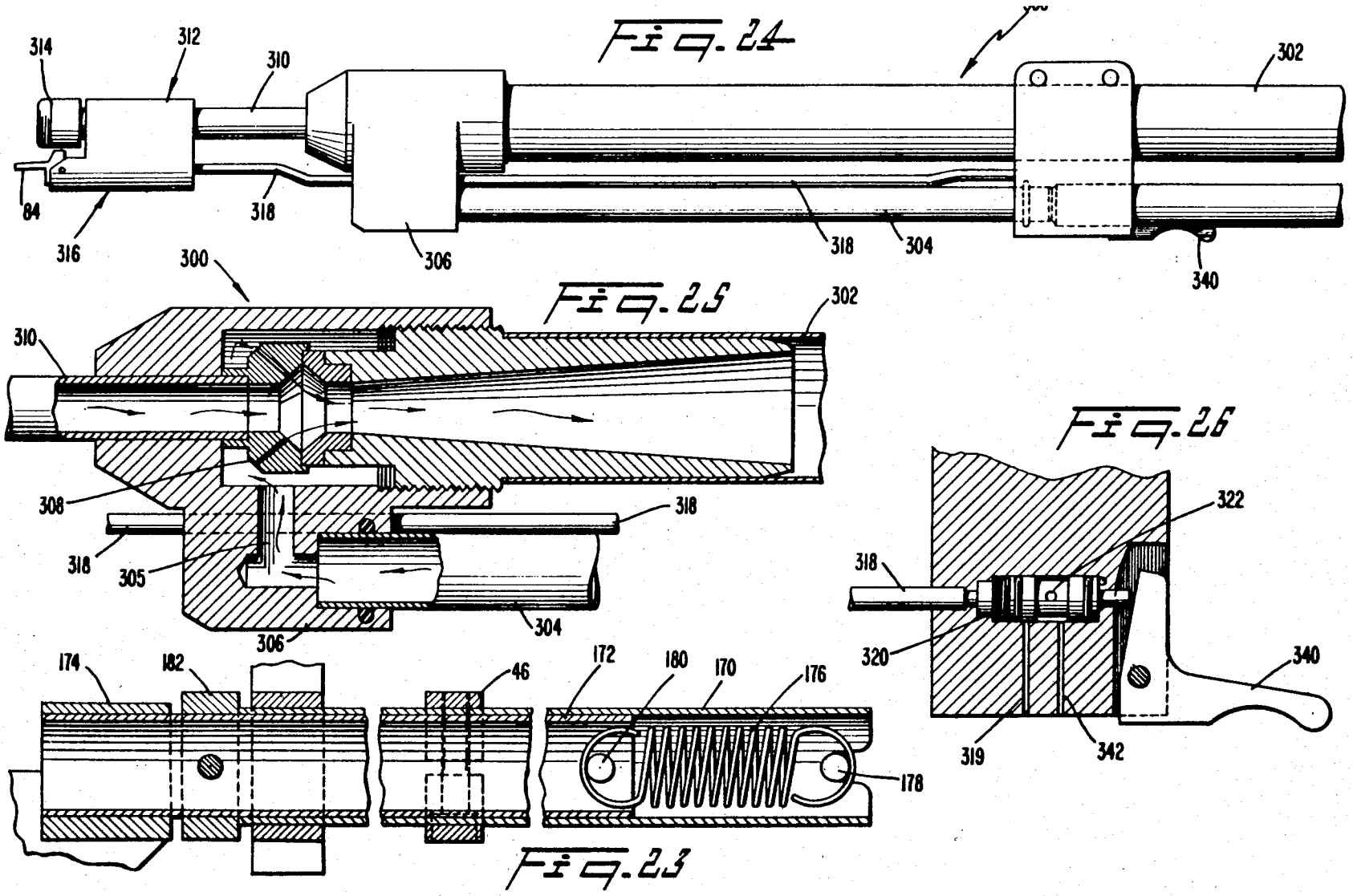
FIG. 23 is a longitudinal sectional view taken through the free end of a yarn transport shaft on which the guide arms are mounted.
FIG. 24 is a side elevational view of a hand-held yarn cutting and aspirating device according to the present invention.
FIG. 25 is a longitudinal sectional view taken through a portion of the hand-held device of FIG. 24 depicting a suction-inducing portion of the device.
FIG. 26 is a sectional view through a portion of the hand-held device according to FIG. 24 depicting a trigger-actuated valve for activating the cutter mechanism.

The guide arms 46, 46' are affixed to a hollow shaft 170 which is oriented parallel to the package axis. This shaft 170 is rotatably mounted on a coaxial bar 172 (FIG. 23) which is, in turn, affixed to a vertically traveling carriage 174 (FIGS. 2 and 23). The shaft 170 rotates relative to the bar 172 about the common longitudinal axis thereof. A spring, preferably a coil spring 176, is connected between the free ends of the shaft and bar by means of pins 178, 180 carried thereby, to bias the shaft (a) rotationally to a position wherein the guide arms 46, 46' are in a rest condition out of the common vertical plane of the yarns, and (b) longitudinally inwardly against a stop element 182 on the bar to properly locate the guide arms along the axis of the shaft. The rotational positioning of the shaft 170 is determined by the spring 176 in conjunction with cam surfaces 202, 204, 206 as will be discussed.

The carriage 174 is mounted for vertical sliding movement upon a stationary upright pole 184. Oriented in an upright position adjacent the pole 184 is a conventional fluid-actuated cable cylinder 186 which includes an internal fluid-actuated piston 188 and cables 190, 192 extending from opposite sides of the piston 188 and passing through seals (not shown) at ends of the clyinder 186. Each cable 190, 192 passes around a free-wheeling pulley 194, 196 and is connected to the carriage 174 such that movement of the piston 188 in one direction creates movement of the carriage 174 in the opposite direction.

Figure 4:
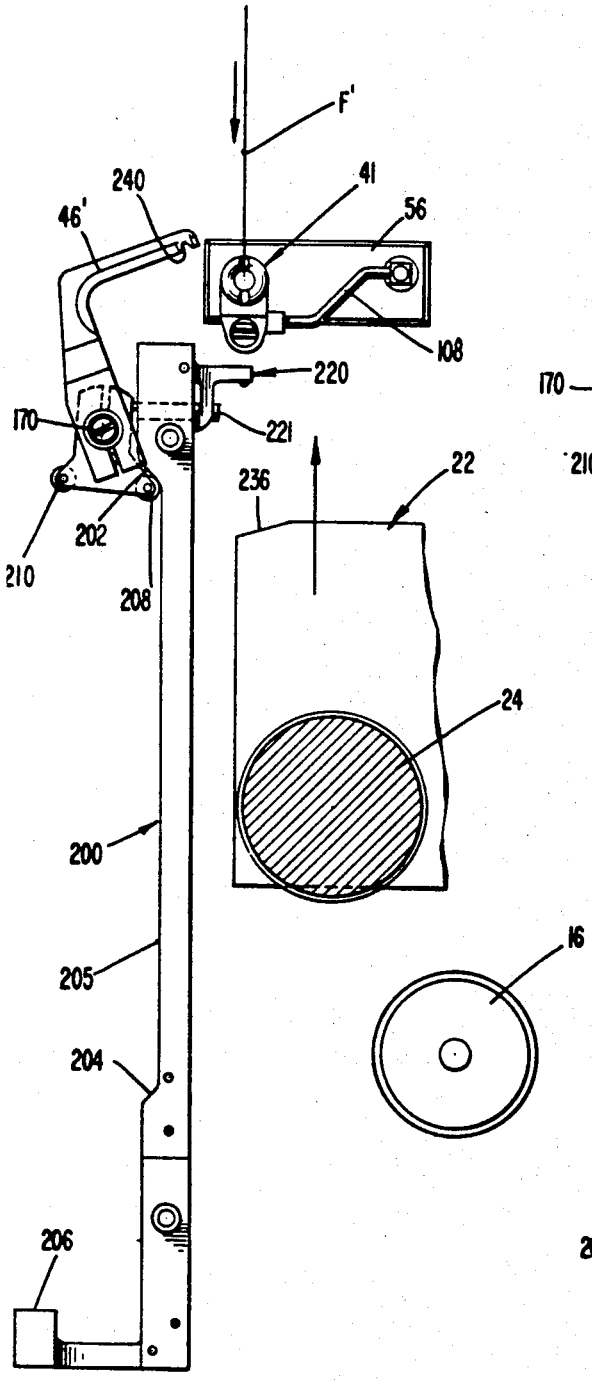
FIG. 4 is a view similar to FIG. 3 depicting a first step of the doffing sequence in which the yarns have been cut and aspirated and a drive head of the winder is ascending.
Figure 7:
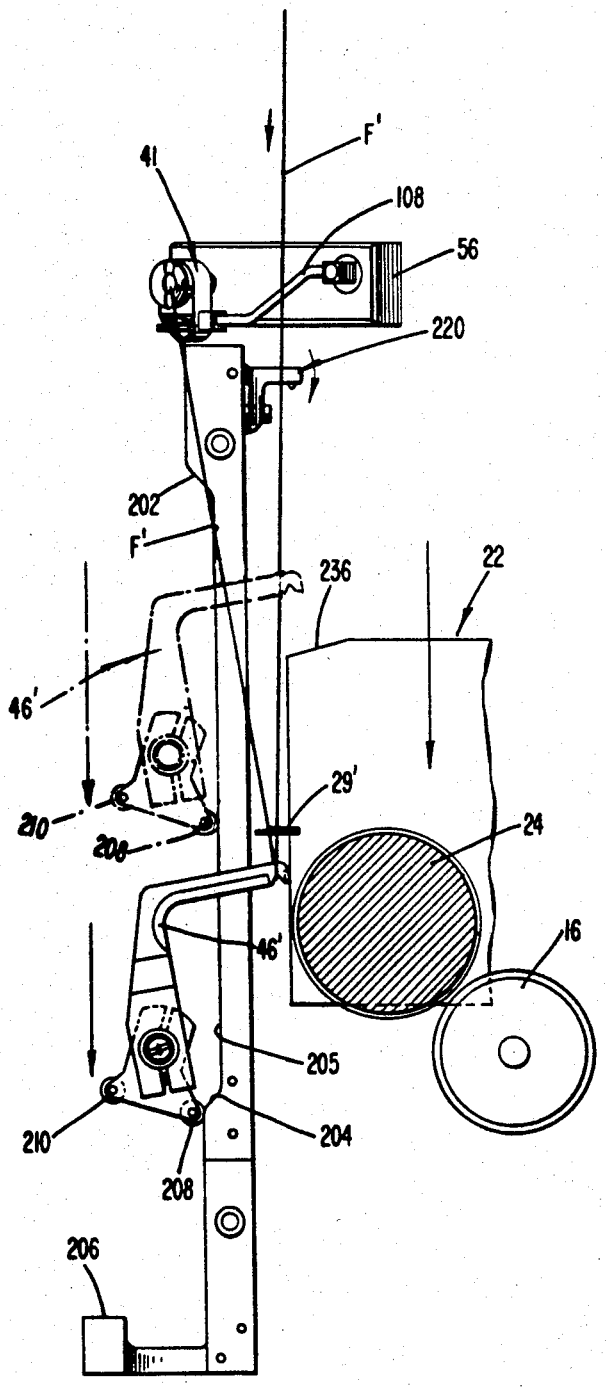
FIG. 7 is a view similar to FIG. 6 depicting a subsequent step in the doffing sequence wherein the guide arms are manipulated to thread the yarns into tailing guides of the winders.

Mounted on the frame 14 adjacent an inner end of the shaft 170 is a stationary cam bar 200 (see FIGS. 2 and 4). The cam bar 200 comprises first, second and third cam surfaces 202, 204, 206 arranged to be contacted by first and second wheels 208, 210 of a cam follower 212 fixedly mounted on the shaft 170. The first and second cam surfaces 202, 204 are separated by a straight surface 205. It will be appreciated that as the carriage 174 ascends and the first cam follower wheel 208 rides upon the first cam surface 202, the shaft 170 will be rotated (clockwise as viewed in FIG. 4) such that the free outer ends of the guide arms 46, 46' approach the winder, i.e., approach the yarn plane and a vertical plane containing the package axis. A similar but more pronounced rotation in the same direction occurs when the second wheel 210 contacts the third contact surface 206 as the carriage descends. When the follower wheel 208 rides upon the second cam surface 204 as the carriage descends, the shaft 170 is rotated (clockwise as viewed in FIG. 7) to enable the free ends of the guide arms 46, 46' to pass by the tailing guides 29, 29'. Thereafter, the arms 46, 46' are swung clockwise to thread the yarns into the tailing guides (FIG. 7).

Figure 5:
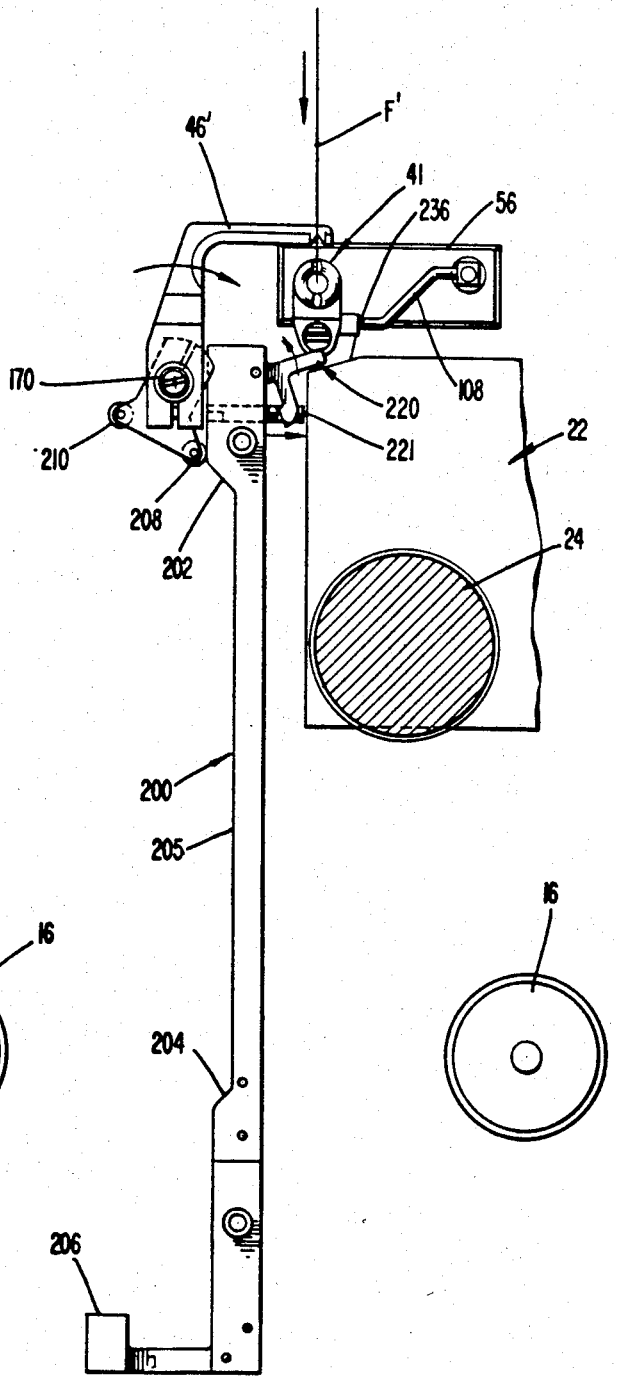
FIG. 5 is a view similar to FIG. 4 depicting a subsequent step in the doffing sequence wherein the drive unit has released a carriage portion of the yarn handling apparatus to enable guide arms of the latter to be swung into operational position.

As a yarn winding operation proceeds, the carriage 174 is continuously urged toward its uppermost limit on the post 184, but is restrained from that limit by means of a releasable stop latch 220 (FIGS. 3, 4, 15, 16). The stop latch 220 comprises a horizontal bolt 221 which slides horizontally in an aperture 222 of the cam bar 200 and is biased by a spring 223 to a position in the travel path of the stop 182 carried by the carriage 174. The bolt 221 is releasable by means of a lever 224 which is pivoted to the cam bar 200 about a horizontal axis 226 and which includes a leg 228 extending into a recess 230 of the bolt 221. A contact leg 234 of the lever 224 extends into the vertical travel path of a cam face 236 of the winder head 12 such that as the winder head 12 is raised (during a yarn package doffing sequence), the bolt 221 is slid open to enable the carriage 174 to complete its ascent, with ensuing rotation of the guide arms 46, 46' as the cam follower wheel 208 rides along the cam surface 202. The latch is disposed sufficiently above the winder head 12 to assure that release of the latch occurs only after the gathering head 41 has severed and aspirated both yarns F, F'. Return of the gathering head 41 to its retracted position cannot occur until the carriage reaches its uppermost position (i.e., until the carriage activates an upper limit switch (not shown)). In this fashion, the carriage completes its ascent and the ends of the guide arms 46, 46' are rotated forwardly into the common plane of the yarns F, F', before the gathering head retracts (FIG. 5).

Figure 6:
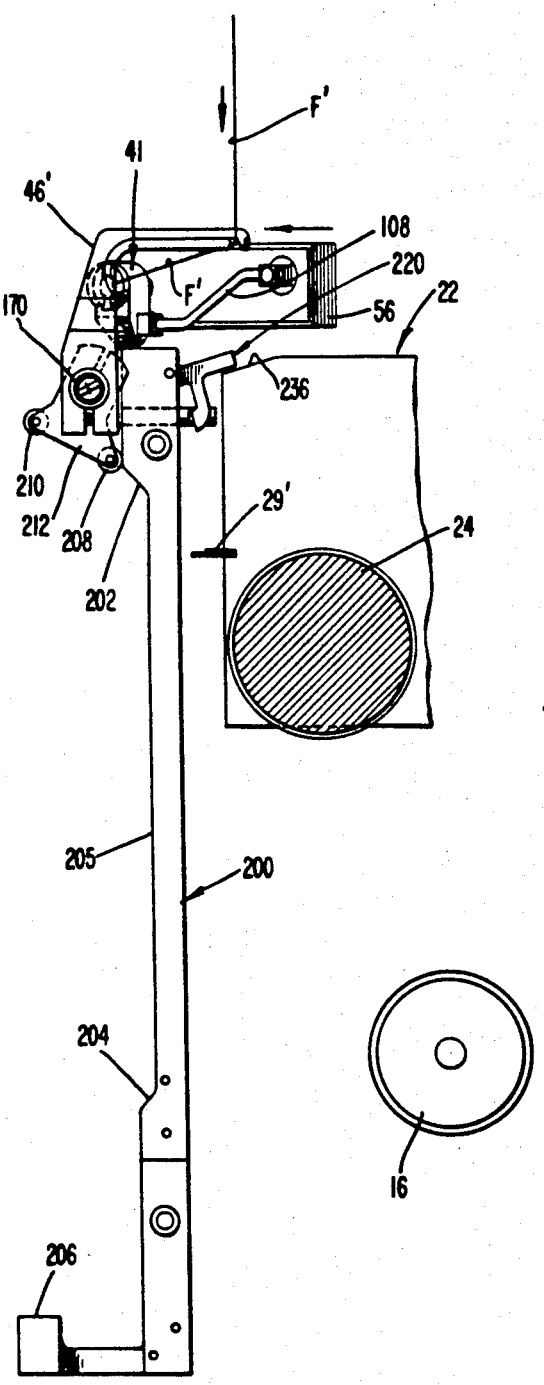
FIG. 6 is a view similar to FIG. 5 depicting a subsequent step in the doffing sequence wherein a gathering head of the yarn handling apparatus has retracted, causing the yarns to be caught by the guide arms.

A first of the guide arms 46 is thus situated inwardly of the first yarn F (i.e., between the frame 14 and the first yarn F), and the second guide arm 46' is situated between the yarn F, F'. When the gathering head is thereafter retracted, the severed yarns F, F' enter grooves 240 formed in the free ends of the guide arms 46, 46'. The yarns thus pass through those grooves 240 on their way to waste via the aspirator. Once the gathering head 41 has been retracted, the limit switch 142 is activated causing the fluid ram 146 to swing the housing 52 about the pin 54 (FIGS. 6 and 12). The mechanism remains in this position while the packages are replaced (either manually or automatically).

Figure 13:
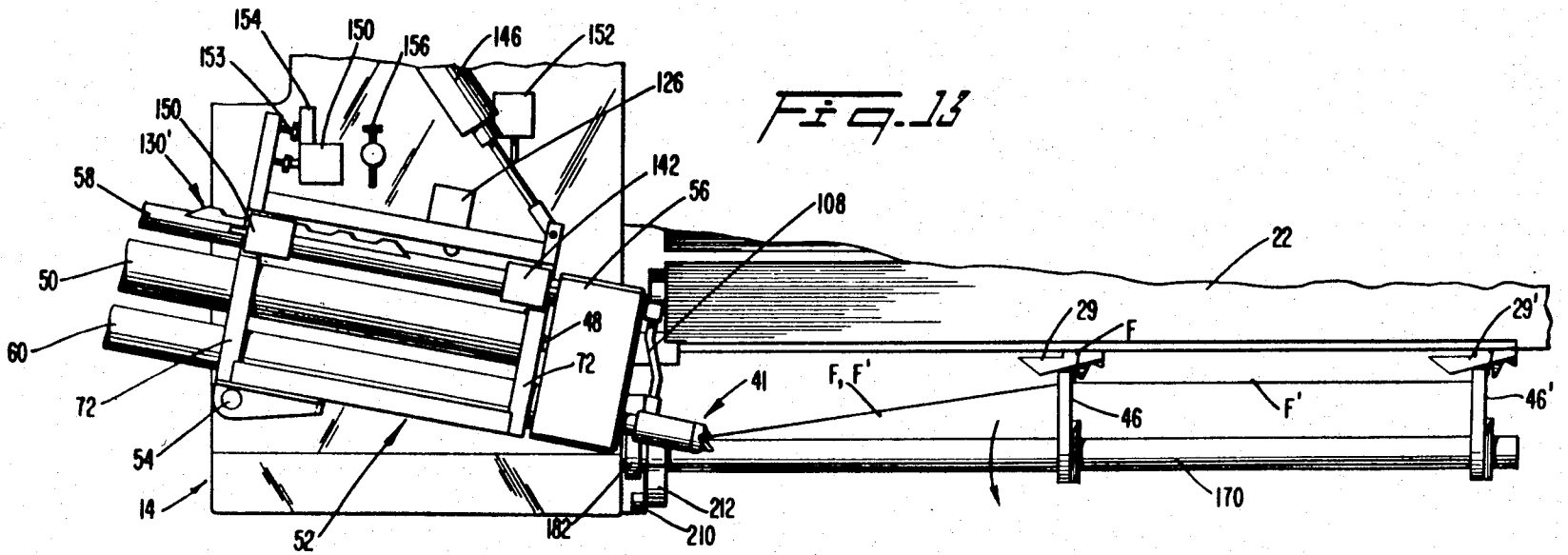
FIG. 13 is a plan view similar to FIG. 12 depicting the operational step corresponding to that depicted in FIG. 7.

It will be appreciated that when the housing 52 and gathering head 41 are rotated together about the pin 54, the yarns F, F' are displaced away from the plane of the winder and will thus enable the yarns to be transported toward the empty packages with no possibility of making contact with the winder. It should also be pointed out that when the gathering head has been rotated to the FIG. 13 position, the outer yarn F' engages the underside of the guide arm 46 of the inner yarn F inwardly of the groove 240 of that guide arm 46, but will later engage that groove 240 during subsequent rearward rotation and descent of the latter. Hence, the outer yarn F' will pass through the grooves 240 of both guide arms 46, 46' during the major part of the descent sequence.

The descent sequence begins with the application of a subsequent signal, either manually from an operator or automatically from an automated system. In response to such signal, the winder head 22 descends toward the packages and the cable cylinder 186 lowers the carriage 174. Accordingly, the first cam follower wheel 208 travels down the cam 202 of the cam bar, whereupon the shaft 170 is rotated under the influence of the spring 176 (FIG. 23) to move the free ends of the guide arms 46, 46' out of the yarn plane while pulling the yarns therealong.

Thereafter, the first cam follower wheel 208 rides along the second cam surface 204 and rotates the outer ends of the guide arms 46, 46' (against the bias of the spring 176) away from the winder and out of the path of the tailing guides 29, 29'. Thereafter, the spring 176 returns the guide arms to a position wherein their outer ends lie beneath the tailing guides 29, 29'. Accordingly, the yarns F, F' are installed into slots thereof open toward the guide arms 46, 46' rather than in a direction parallel to the package axis as is standard in manual doffing systems.)

Figure 9:
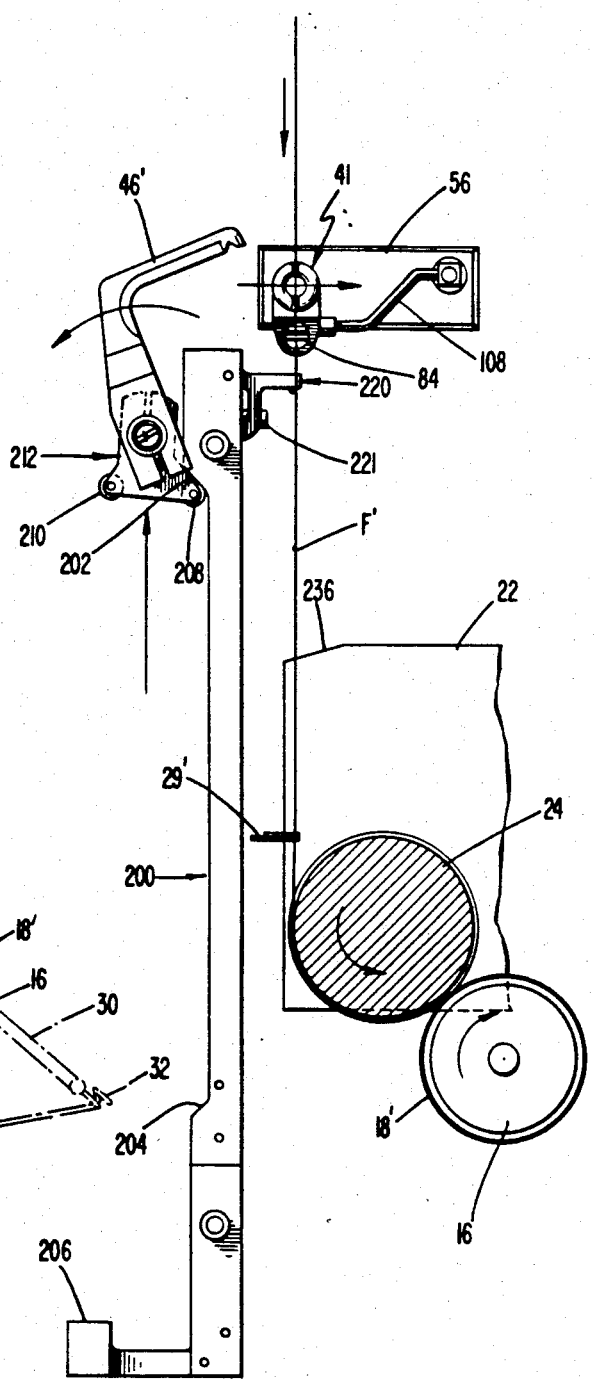
FIG. 9 is a view similar to FIG. 8 wherein the guide arms are returned to a starting point of FIG. 3 following completion of the doffing sequence.

As the carriage 174 further descends, the second cam follower wheel 210 contacts the third cam surace 206 and causes the ends of the guide arms 46, 46' to be swung still further toward the winder to a position just below and beyond the standard throw-on guides 32. At this point, the carriage 174 engages a lower limit switch (not shown) to actuate a timer which, after counting down to enable the bobbins to reach full speed (the latter being engaged and driven by the drive unit 22), signals the control mechanism for the throw-on guides 32. The guides 32 are then rotated to carry the yarns under the packages and into standard pinch grooves in the packages. The yarns are thus placed in tension between the aspirator and the pinch grooves and are caused to break. Accordingly, the tailing ends of the yarns are sucked to waste, the newly formed lead ends of the yarns are wound upon the packages (FIG. 9), and the carriage re-ascends into engagement with the stop latch 220.

It will be appreciated that in lieu of transferring the yarns to the throw-on guides 32, the present invention could be designed to insert the yarns directly into the package pinch grooves.

OPERATION

To facilitate a complete understanding of the invention, the entire operational sequence of the filament handling system according to an aspect of the invention will now be summarized.

In operation, a filament winding operation proceeds in the usual fashion, with the drive unit rotating the yarn package and gradually rising as the package becomes filled. The yarns F, F' travel downwardly through the traversing guides 28, 28' through the helical slots 26, 26' in the driven roll 24, and onto the packages 18, 18'.

Figure 3:
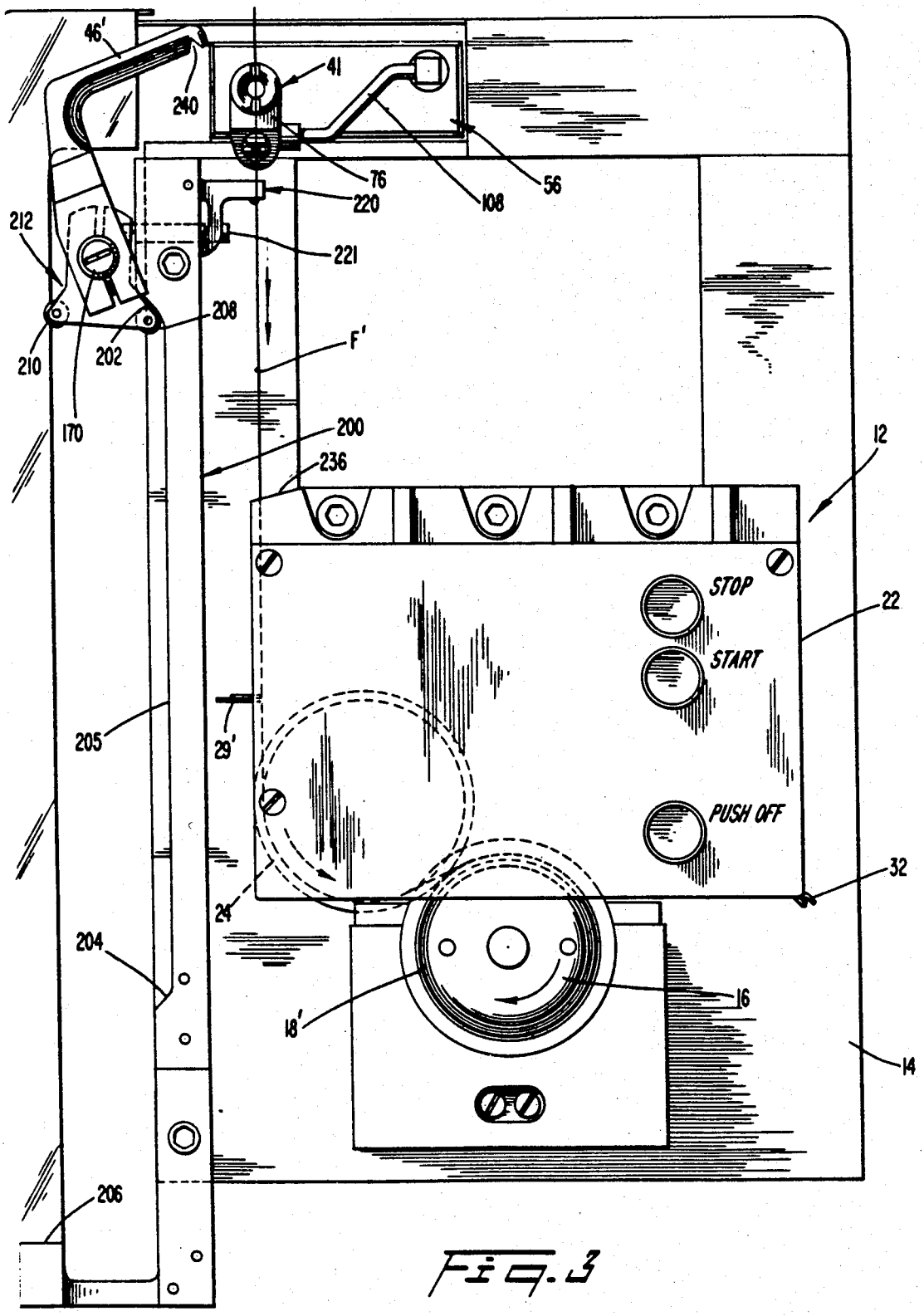
FIG. 3 is an end elevational view of the apparatus disclosed in FIG. 1 as a package winding sequence precedes.

The yarn handling apparatus 40 according to the present invention waits in a park or rest mode (FIGS. 1, 2, 3, and 10), with the carriage 174 being urged upwardly by the cable cylinder 186 against the stop latch 220 (FIGS. 3 and 15). In this position, the free ends of the guide arms 46, 46' are located outwardly from the common vertical plane of the yarns F, F'. The gathering head 41 awaits in a retracted position generally within that common plane.

When the winding operation is completed, a signal is furnished to the machine. This signal may be produced by an operator manually pushing a "stop" button on the winder (FIG. 3), or by means of a signal from a computer if the winder is part of an automated system. In response to that signal, pressurized fluid is supplied to the hydraulic cylinder 50 which extends the reciprocable mechanism 47, including the gathering head 41, toward the yarns F, F'. Eventually, the first or inner yarn F enters the slot 90 of the stationary blade 84 and becomes trapped within the lateral position 96 of that slot (FIG. 19). The yarn F is thus received within the vertical slit 80 in the aspirator tip 78 and is pressed tightly therein as the yarn F continues to be wound upon the package 18.

As the cams 128' make contact with the follower arm 136 of the poppet valve (FIG. 17), pressurized fluid is supplied to the working compartment of the chamber 104 in the cutter sleeve 76. When pressure in that compartment 104 builds-up sufficiently to overcome the restraint imposed by the detent 122, the reciprocable blade 82 snaps outwardly across the lateral portion 96 of the slot 90 (FIG. 23), thereby severing the yarn F which is immediately sucked into the aspirating conduit 69.

As the gathering head 41 advances further, a similar operation is performed on the second yarn F' which is also severed and aspirated into the aspirator conduit due to cams 128 making contact with the follower arm 136 of the poppet valve. Thus, both yarns now travel into the suction conduit 69 and are aspirated to waste. At the end of the forward stroke of the gathering head, the limit switch 140 is activated, thereby instigating a signal to the winder which causes the drive head 22 to ascend, thereby breaking drive relationship with the packages (FIG. 4).

Thereafter, the ascending drive head 22 engages the latch disengagement lever 234 and retracts the stop bolt 221 (FIGS. 5 and 16). This enables the carriage 174 to complete its upward movement, whereby the first cam follower wheel 208 engages the first cam surface 202 and swings the guide arms toward the winder (FIG. 5). Accordingly, the free ends of the guide arms become disposed within the yarn plane inside of the respective yarns (i.e., between the frame 14 and the respective yarn). When the carriage 174 reaches its uppermost position, a limit switch is activated, which initiates retraction of the gathering head 41. Accordingly, the hydraulic cylinder 50 retracts and the gathering head 41 returns to its original retracted position. During such retraction, the yarns F, F' respectively engage the grooves 240 of the guide arms 46, 46'. At the end of the retraction stroke, the limit switch 142 is activated, causing the fluid ram 146 to rotate the housing 52 about the pin 54 to displace the tip 78 of the aspirator conduit 69 away from the yarn plane (FIGS. 6 and 12). In so doing, it is assured that the yarns F, F' will not contact the winder during subsequent descent of the guide arms.

The yarn handling mechanism now rests in this position as the packages 18, 18' are replace, either manually or automatically. The yarns F, F' sucked-in through the aspirator 69, 78 are delivered to waste. Thereafter, a restart signal is delivered to the machine, either by manual depression of a "start" button on the winder or by a computer signal in an automated system. Such restart signal actuates the cable cylinder 186 to lower the carriage 174, such that the first cam follower wheel 208 leaves the first cam surface 202, thereby causing the guide arms 46, 46' to rotate about the axis of the shaft 170 and swing the filaments outwardly from the original yarn plane (see broken line position in FIG. 7).

Figure 8:
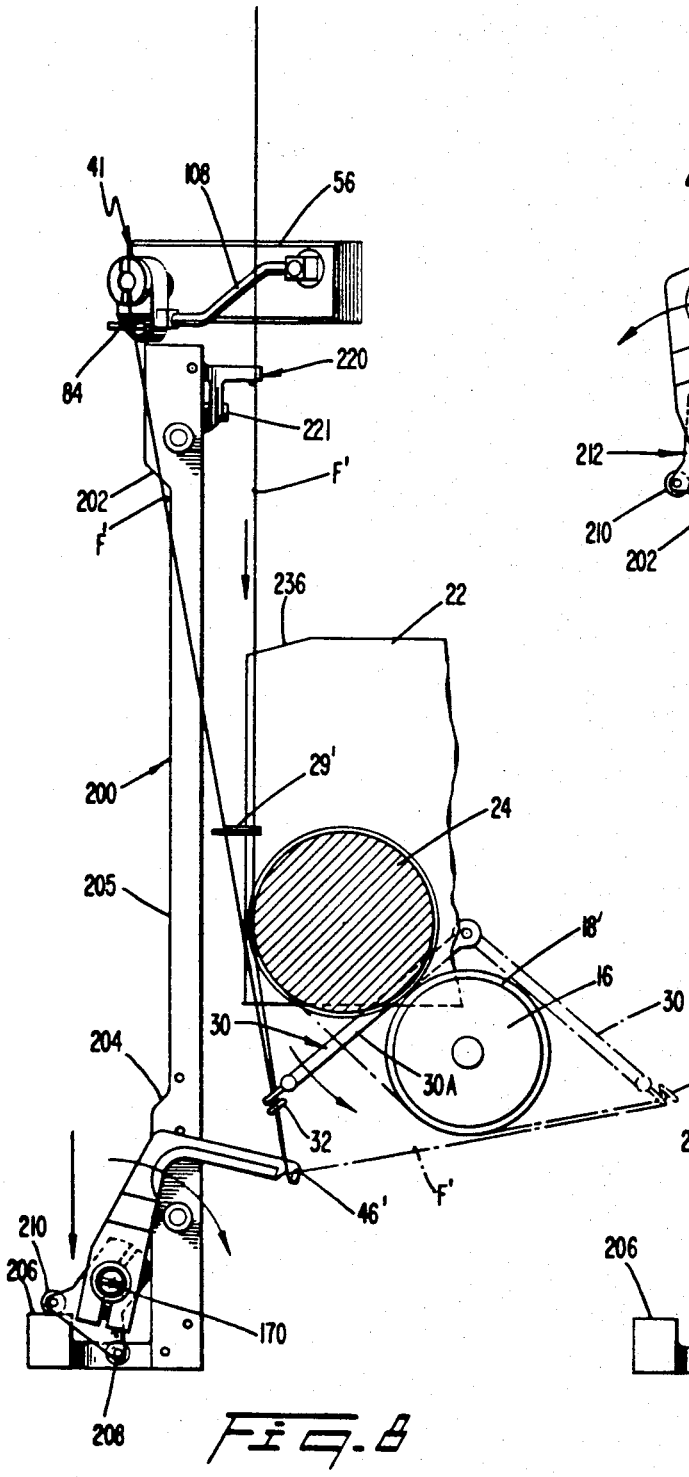
FIG. 8 is a view similar to FIG. 7 depicting a subsequent step in the doffing sequence wherein the guide arms are manipulated to a position enabling thrown-on guides of the winder to capture the yarns.

The carriage 174 continues its descent until the first cam follower wheel 208 engages the second cam surface 204 and causes the guide arms 46, 46' to swing toward the winder so that the free ends of the guide arms are located below the tailing guides 29, 29' to thread the yarns F, F' into those tailing guides (FIGS. 7 and 13). Further descent of the carriage 174 brings the second cam follower wheel 210 into engagement with the third cam surface 206 which produces further rotation of the free ends of the guide arms 46, 46' toward the winder 12 at a location below the standard rethreading guides of the winder (FIGS. 8 and 14). As a result, the yarns F, F' are positioned to become picked-up by the standard throw-on guides 32, when the latter are swung toward the empty packages. When the carriage 174 has fully descended, a limit switch is activated, thereby starting a timer which controls the moment at which the throw-on guides 32 are swung toward the empty packages. This time period is required in order to assure that the drive head 22 has sufficient opportunity to bring the empty packages up to final speed. The actual rethreading of the yarns occurs in a conventional manner as the throw-on guides insert the yarns F, F' into the usual pinch slots in the empty packages. Accordingly, the yarns are captured by the rapidly rotating packages, thus producing tension in the yarns between the packages and the aspirator 69 of such a degree that the yarns are broken (FIG. 8).

With the rethreading operation completed, the carriage 174 ascends into engagement with the latch 220 and the fluid ram 146 swings the housing 52 about the vertical pivot pin 54, thereby returning the gathering head 41 to its normal rest position (FIGS. 1, 2, 3 and 10).

It will be appreciated that the yarn handling apparatus according to the present invention is highly advantageous in that it is capable of convenient retrofit to existing winders without appreciable modification of the structural components of the latter. The apparatus functions in a relatively simplified manner, thereby minimizing malfunction and break down. For example, the gathering head remains at rest during the actual transfer of the yarns toward the empty packages; only the guide arms need be displaced during this sequence. Moreover, the movements of the transfer guide arms are simplified in that the guide arms do not pass through the vertical plane containing the package axis. Rather, the guide arms remain to one side of such plane. Conveniently, the guide arms are able to rethread the conventional transfer tail devices mounted on the winder.

As a matter of further convenience, the control mechanism for the yarn handling apparatus is disposed at the anchored end of the package axle and thus is not disposed to interfere with the exchange of packages by a robot or an operator at the free end of the package axle.

The actual severing of the filaments is facilitated because the cutter mechanism is able to receive the yarns in the direction of reciprocation of the gathering head. This assures that the yarns will eventually enter and be captured by the cutter slot as the gathering head travels through the yarn plane. The cutter blades themselves make sharp, crisp cuts through all the filaments in each yarn because the blades are pressed together during the severing stroke, and since the cutting stroke is only initiated when a selected pressure build-up is attained to produce a "snaplike" action of the cutting stroke. The pressing of the blades together renders the blades self-sharpening during movement thereof. The combination of a curved cutting edge on one blade and a straight cutting edge on the other blade creates a highly efficient combination of scissors and shearlike cutting actions on the filamentary yarn.

The gathering head according to the present invention is ideally suited not only to an automated system, but to a hand-held aspirator as well, and greatly facilitates capturing of the filaments as well as the severing and aspirating aspects thereof. It has been used many thousands of times in the winding of polyester yarn, without a single recorded failure.

Manual Severing and Aspirating Gun

It will be appreciated that although the cutter mechanism of the present invention has great utility in an automated mechanism, it also has utility as an attachment to an aspirator "gun" which is maneuvered manually by an operator. Such a device 300 is depicted in FIGS. 24 to 26 in which an elongated, rigid fluid outlet tube 302 has attached thereto an elongated rigid fluid inlet tube 304. The latter conducts pressurized fluid, such as air, forwardly (i.e., to the left as viewed in FIG. 24). This air is delivered to the outlet tube 302 through a cross-bore 305 in a casing 306. The air enters the outlet tube 302 via an apertured nozzle 308 whereby a rearward suction is created in the customary manner in a forward extension 310 of the outlet tube 302.

Mounted at the front end of the extension or suction tube 310 is a gathering head 312 which operates under the same basic principles as the afore-described gathering head 41 (FIGS. 19–22) in that it has an aspirator tip 314 and a cutter mechanism 316 disposed therebelow. The cutter mechanism may be identical to that previously described, although in a manual device such as this, it might be desirable to invert the positions of the blades 82, 84 so that the stationary blade 84 is located atop the reciprocable cutter. In this fashion, the flared portion 100 of the through-passage 96 would be disposed at the top rather than at the bottom. It is probably less damaging to a yarn to travel initially through the flared end 100 of the passage 96 than through the end thereof having the sharp edge 98, especially in a manual device where it is likely that the residence time of the filament in the blade 84 prior to severing will be longer than in the automated mechanism.

Pressurized air is supplied to the cutter mechanism via a conduit 318. That air is bled from the air inlet tube 304 via a passage 319 which cooperates with a poppet valve 320 (FIG. 26). The latter is of standard design and includes a central passage 322 which communicates with the passage 319 when a spring-biased trigger 340 is actuated. At all other times, the central passage communicates the cutter with an exhaust passage 342.

In practice, the operator lines-up the device 300 with the yarn to be severed and then merely advances the device, knowing that the yarn will become entrained within the lateral portion 96 of the slot 90 (see FIGS. 19, 20). Thereafter, the trigger 340 is activated to sever the filament, thereby causing the yarn to be aspirated to waste via the tubes 310, 302.

It will be appreciated that in some instances the yarns to be severed are somewhat remote from the operator and not easily accessible. Previously proposed manual severing and aspirating devices which have laterally opening slots can be inconvenient due to difficulty in aligning the slot with the yarn. Such a problem is not present in the case of a forwardly opening slot as in the present invention.

Although the invention has been described in connection with preferred embodiments thereof, it will be appreciated that modifications, substitutions, deletions, and additions not specifically described, may be made without departing from the spirit and scope of the invention as defined in the appended claims. For example, it will be appreciated that the invention is not limited to one in which the yarns being fed to the winder are in a vertical plane. Further, the path of movement of the yarn transfer means obviously depends upon geometrical considerations that are specific to the type of winder, particularly where the automatic apparatus is retrofitted to an existing winder.

What is claimed is:

1. Automatic filamentary yarn handling apparatus for use with a filamentary yarn winder of the type comprising a yarn package support, and means for rotating at least one package about an axis of said support to wind-up at least one filamentary yarn continuously fed along a yarn path toward the winder, said yarn handling apparatus comprising:

gathering means upstream of said package's rotary axis for displacement from a rest position toward the path of travel of the yarn, said gathering means including:

cutter means for severing said yarn as said gathering means is displaced toward said yarn's path of travel, suction means including an inlet disposed adjacent said cutter means for continuously drawing-in said yarn after severing has occurred, yarn transfer means, including at least one guide associated with said yarn being transferred, mounted for movement relative to said gathering means between spaced positions, said guide being arranged to engage said yarn upon said gathering means returning to its rest position with the severed yarns, and displacement means for:

moving said transfer means relative to said gathering means with the yarn remaining engaged with said guide, and moving said guide toward the package axis during a yarn rethreading sequence.

2. A yarn handling apparatus according to claim 1, wherein said cutter means is disposed immediately below said inlet of said suction means, and said gathering means is vertically spaced from said package's rotary axis.

3. A yarn handling apparatus according to claim 2, wherein said cutter means comprises a first blade and a reciprocable blade, said first blade including a slot within which said yarn filament is captured, and means for reciprocating said reciprocable blade relative to said slot to sever the filament.

4. A yarn handling apparatus according to claim 3, wherein said slot opens in the direction of travel of said gathering means.

5. A yarn handling apparatus according to claim 4, wherein said slot includes a lateral extension in which said yarn becomes trapped.

6. A yarn handling apparatus according to claim 3, including spring means for displacing said reciprocable blade in one of its directions, said spring means acting against said first blade in a manner urging the latter against said reciprocable blade.

7. A yarn handling apparatus according to claim 6, including means for delivering pressurized fluid for displacing said reciprocable blade in the other of its directions, and yieldable detent means resisting displacement of said reciprocable blade in said other direction until a preselected fluid pressure build-up is present.

8. A yarn handling apparatus according to claim 1, wherein two yarns are being wound, said transfer means comprising two said guides, each guide associated with a respective yarn.

9. A yarn handling apparatus according to claim 8, wherein said yarn transfer means comprises a vertically movable carriage, said guides being mounted on said carriage for movement relative thereto toward and away from a common plane of said yarns.

10. A yarn handling apparatus according to claim 9, wherein said guides are rotatable on said carriage about an axis disposed parallel to said bobbin rotary axis, cam means arranged along the path of travel of said carriage for imparting rotary movement to said guides toward a vertical plane containing said package axis, and spring means biasing said guides away from said plane.

11. A yarn handling apparatus according to claim 1, wherein said winder includes at least one tailing guide for creating a yarn tail on the package, said displacement means moving said guide toward said tailing guide to thread the yarn thereinto prior to the yarn being threaded onto an empty package during said rethreading sequence.

12. A yarn handling apparatus according to claim 1, wherein said gathering means is arranged to be stationary during vertical displacement of said transfer means.

13. A yarn handling apparatus according to claim 1, wherein said cutter means includes a fluid-actuated displaceable blade, means for supplying pressurized fluid to said gathering means for creating suction in said suction means, and means for supplying pressurized fluid to said displaceable blade intermittently to drive the latter through successive cutting strokes.

14. A yarn handling apparatus according to claim 1, wherein said gathering means is mounted at the end of a reciprocable rod arranged to reciprocate above said package axis and parallel thereto, said rest position of said gathering means disposed adjacent an anchored end of said package support.

15. A filamentary yarn handling apparatus for use with a yarn winder of the type comprising a package support, and means for rotating first and second packages about an axis of said support to wind-up first and second filamentary yarns traveling downwardly along yarn paths toward the winder, said yarn handling aparatus comprising:

a gathering head mounted above said package support rotary axis for displacement in a common plane of said yarns toward the paths of travel of the yarns, said gather head including:

cutter means for severing each yarn as said aspirator is displaced toward said filament paths of travel, suction means including an inlet disposed above said cutter means for continuously drawing-in each yarn after severing has occurred, filamentary yarn transfer means, including at least first and second guides, mounted for movement relative to said gathering head between upper and lower positions along one side of said package support axis, with said transfer means being in said upper position, said first and second guides are respectively located between said rest position of said gathering head and first and second ones of said paths of yarn travel, respectively, such that when said cutter means severs said yarns and said gathering head returns to its rest position with said first and second yarns, said first and second yarns engage said first and second guides, respectively, on said one side of said package support axis, and displacement means for:

moving said transfer means along said one side of said package support axis from said upper position to said lower position relative to said gathering means and with the yarns remaining engaged with said guides, and moving said first and second guides toward the package support axis, in said lower position of said transfer means, during a yarn rethreading sequence.

16. A yarn handling apparatus according to claim 15, wherein said cutter means comprises a first blade and a reciprocable blade, said first blade including a slot within which a filament is captured, and means for reciprocating said reciprocable blade relative to said slot to sever the yarn.

17. A yarn handling apparatus according to claim 16, wherein said slot opens in the direction of travel of said gathering means.

18. A yarn handling apparatus according to claim 17, wherein said slot includes a lateral extension in which said yarns become trapped, said extension disposed rearwardly of said suction inlet to urge the yarn against said inlet.

19. A yarn handling apparatus according to claim 16, including spring means for displacing said reciprocable blade in one of its directions, said spring means acting against said first blade in a manner urging the latter against said reciprocable blade.

20. A yarn handling apparatus according to claim 15, wherein said winder includes a plurality of tailing guides for creating yarn tails on the packages, said displacement means moving said guides toward said yarns toward said tailing guides to thread the yarns thereinto prior to the yarns being threaded onto empty packages, during said rethreading sequence.

21. A yarn handling apparatus according to claim 15, wherein said gathering head is arranged to be stationary during vertical displacement of said transfer means.

22. A yarn handling apparatus according to claim 15, wherein said package support comprises a cantilevered spindle mounted at one end, said rest position of said gathering head is disposed adjacent said one end of said spindle, and wherein each said package is a tube.

* * * * *